US005134856A

United States Patent [19]

Pillis et al.

[11] Patent Number: 5,134,856

[45] Date of Patent: Aug. 4, 1992

[54] OIL PRESSURE MAINTENANCE FOR SCREW COMPRESSOR

[75] Inventors: Joseph W. Pillis, Hagerstown, Md.; Milton W. Garland, Waynesboro, Pa.

[73] Assignee: Frick Company, Waynesboro, Pa.

[21] Appl. No.: 703,795

[22] Filed: May 21, 1991

[51] Int. Cl.[5] ..... F25B 31/00

[52] U.S. Cl. ..... 62/193; 62/470; 62/196.4; 418/DIG. 1

[58] Field of Search ..... 62/193, 470, 473, 196.4, 62/DIG. 17; 417/282; 418/DIG. 1

[56] References Cited

U.S. PATENT DOCUMENTS 2,128,388 8/1938 Williams et al. .
2,155,051 4/1939 Kagi .
2,338,486 1/1944 Bixler .
2,418,853 4/1947 Shoemaker .
3,827,255 8/1974 Kish .
3,850,009 11/1974 Villadsen ..... 418/DIG. 1
4,180,986 1/1980 Shaw ..... 62/473
4,653,286 3/1987 Huenniger .
4,749,166 6/1988 Huenniger .
4,916,914 4/1990 Short .

*Primary Examiner*—Albert J. Makay
*Assistant Examiner*—J. Sollecito
*Attorney, Agent, or Firm*—Dowell & Dowell

[57] ABSTRACT

A pressurized supply of oil for lubrication and other purposes for a helical screw compressor is automatically and continuously maintained in an oil separator in the compressor discharge line by a check valve assembly which is controlled by the pressure differential between the compressor inlet and the condenser, a bypass around the valve's control element permitting equalization of pressure on its opposite sides to permit closing by a biasing element.

13 Claims, 2 Drawing Sheets

OIL PRESSURE MAINTENANCE FOR SCREW COMPRESSOR

BACKGROUND OF THE INVENTION

1. Field of the Invention

This invention relates to compressors and more particularly to the maintenance of a pressurized oil supply during compressor operation without the need for a mechanical pump.

2. Description of the Related Art

A typical refrigeration system using a helical compressor and an oil pump for circulation is disclosed in the Short U.S. Pat. No. 4,916,914. The Bixler U.S. Pat. No. 2,338,486 also discloses oil circulation by a pump. In Bixler the compressor is kept unloaded until the oil pressure provided by the lubricating pump is adequate.

The Shoemaker U.S. Pat. No. 2,418,853 discloses a compressor system having a valve in a suction line which shuts down if the pressure is below a predetermined minimum, thereby maintaining a predetermined pressure in the compressor crank case.

The Kagi U.S. Pat. No. 2,155,051 discloses a gravity operated check valve in a compressor discharge which leads to an oil separator whereby oil is separated as required. The Williams U.S. Pat. No. 2,128,388 discloses a system in which during compressor operation oil under pressure opens a valve to permit oil from the crank case to flow to a reservoir.

The Kish U.S. Pat. No. 3,827,255 discloses a conventional spring biased check valve in the discharge line from a compressor.

The Huenniger U.S. Pat. No. 4,653,286 and 4,749,166 disclose a discharge valve and baffle assembly connected to the condenser of a centrifugal compressor discharge and operative to remain closed until the compressor reaches operating speed, dependent upon the compressor operating suction pressure.

SUMMARY OF THE INVENTION

In the operation of a screw compressor it is essential that a supply of lubrication quality oil be available at all times of operation, including start-up, for lubrication, sealing, cooling and other purposes. In the past this has often been accomplished by means of a separate mechanical oil pump. Such oil pump has been controlled so that it begins operation and provides oil under pressure as soon as a compressor is started.

After the compressor starts it will generally begin to build a (system) differential pressure between the evaporator, at suction pressure, and the condenser at discharge pressure. The oil separator will have discharge pressure gas on top of the oil sump and this pressure can be used for circulation of oil without the use of an oil pump.

The difficulty with attempting to rely on the system differential pressure for supplying oil is that such pressure may not be available for an extended time after start-up, until the evaporator pressure can be pulled down by the compressor, and until load drives the condenser pressure up.

Thus, after a period of shutdown, the compressor has a need for lubrication, but the necessary pressure may not be available for minutes or hours while the system pressure differential is being established.

It is an object of the present invention to provide a system in which the oil separator pressure will be quickly elevated after the compressor starts to a level suitable to deliver oil for lubrication. While this function could be easily provided by a spring biased valve in the discharge line, this would require the compressor to use excessive energy all the time in overcoming the pressure drop of this valve.

It is a further object of this invention that when sufficient pressure differential is available between the evaporator and condenser that this differential be used to circulate oil, with the oil separator pressure nearly equal to condenser pressure, thus eliminating excessive energy consumption.

It is a further object of the invention to provide a system for providing such oil pressure continuously and automatically and which has the additional function of a check valve to prevent high pressure vapor backflow following and during a shutdown.

These and other objects of the invention will become apparent from the following description in conjunction with the accompanying drawings in which.

DESCRIPTION OF A PREFERRED EMBODIMENT

Figure 1:
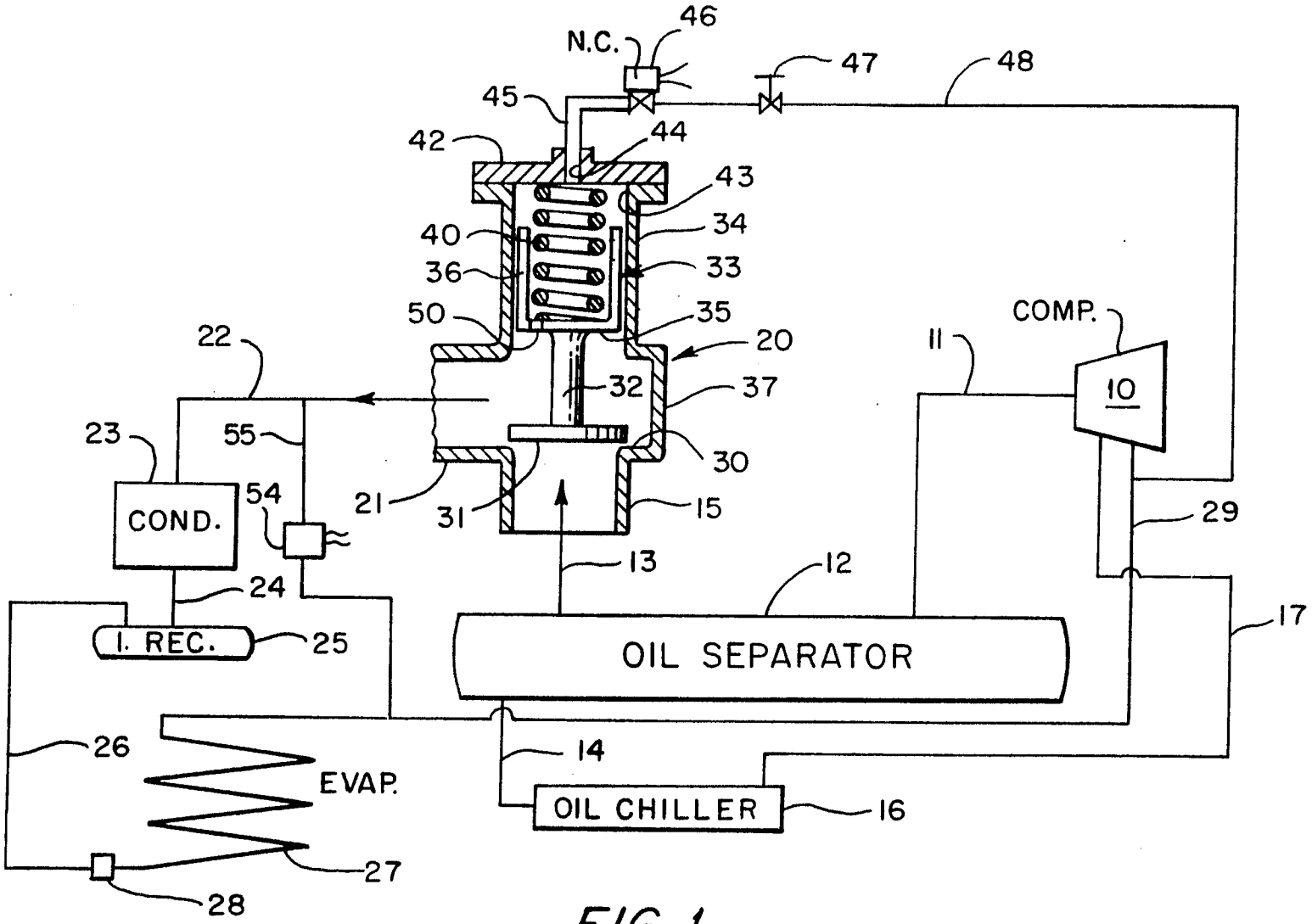
FIG. 1 is schematic of an embodiment of the invention.
Figure 3:
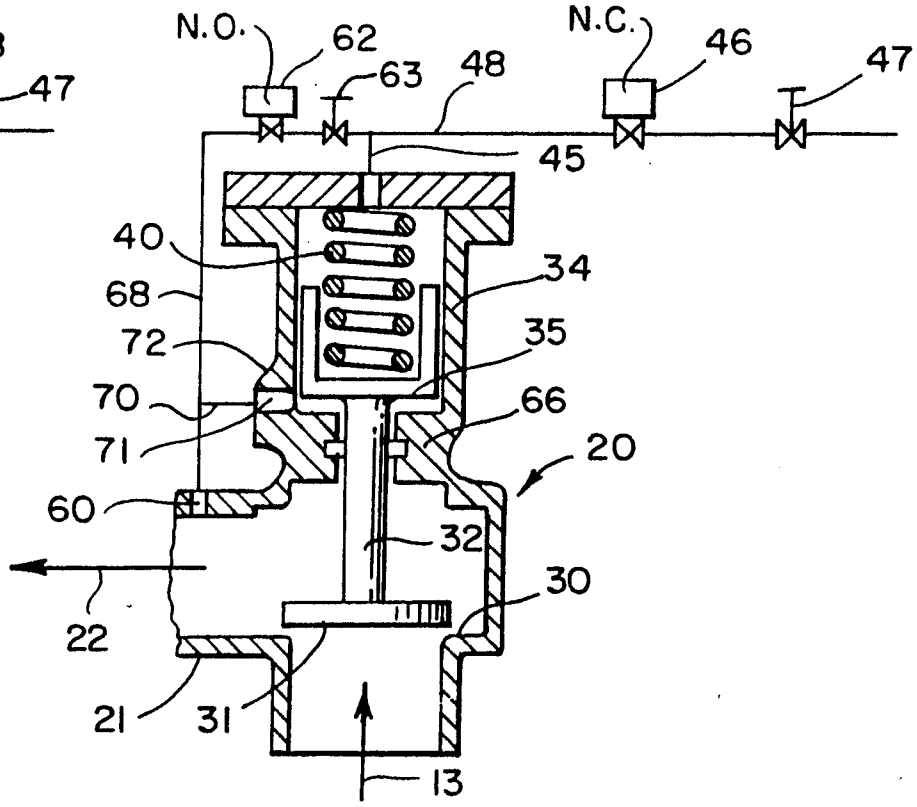
FIGS. 2 and 3 are schematics of modifications.
Figure 2:
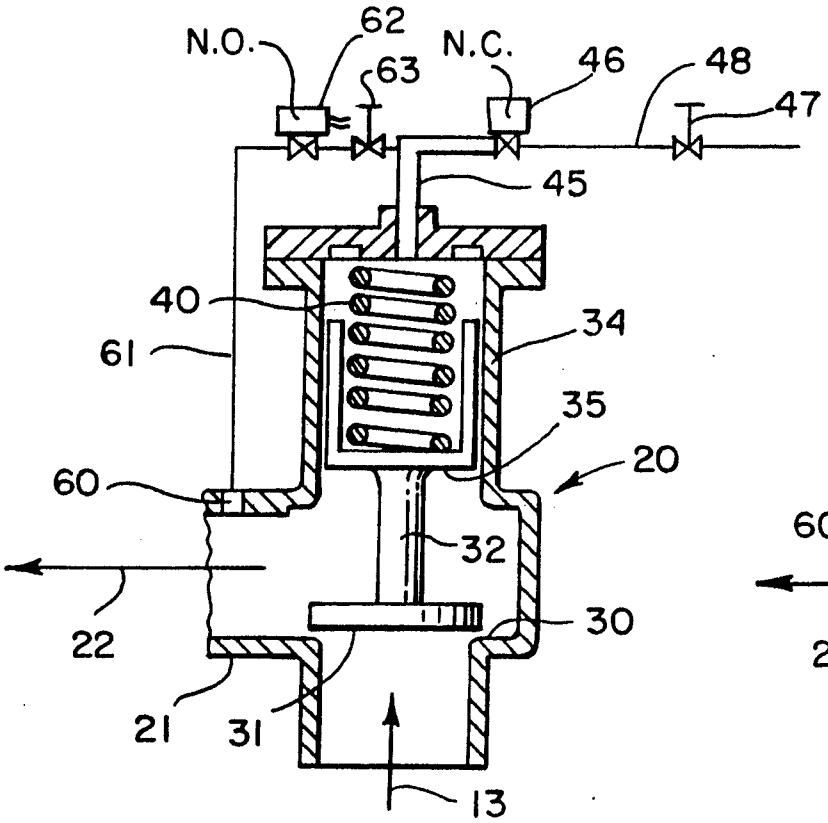

FIGS. 1, 2 and 3 illustrate the invention as employed in a vapor compression refrigeration system having a high pressure side and a low pressure side as commonly understood. See, for example, 1989 ASHRAE Handbook, Fundamentals, page 1.8. The system includes a compressor 10 feeding to discharge line 11 into an oil separator 12 having a vapor outlet 13 and a lower oil outlet 14. The oil outlet 14 returns to the compressor for various lubricating, cooling and other functions as may be required. The vapor line 13 feeds to the inlet 15 of a valve assembly 20, the details of which will be described later.

The valve assembly has an outlet 21 to a discharge line 22 leading to a condenser 23 having an outlet 24 feeding to a receiver 25 having an outlet 26 to an evaporator 27 by means of a suitable flow restriction valve 28. From the evaporator a return line 29 is connected to the compressor suction or inlet.

The oil separator 12 is of the conventional type and its oil discharge line 14 ordinarily feeds to a chiller 16 prior to entering a return line 17 to the compressor 10.

The valve assembly 20 of FIGS. 1, 2 and 3 has a housing with a seat 30 which is engaged by a button or control face 31 mounted on a rod 32 connected to a piston 33 that reciprocates within a cylinder 34 forming part of the housing. The piston 33 has an end wall 35 and side wall 36. The interior of the piston is substantially cup-shaped to receive a coil spring 40 one end of which engages the end wall 35 of the piston and the other of which engages a valve cover 42 which closes an end 43 of the housing.

The valve cover 42 has an opening 44 connected by a fitting to a pipe 45 which is connected through solenoid valve 46 and hand control valve 47 to a line 48 connected to the compressor inlet 29.

The piston end wall 35, in FIG. 1, has a bleed opening 50 in order to permit vapor within the housing bell portion 37 of the valve to pass from the lower side of the end of the piston 35 to the upper in which it is in communication with outlet 45.

In order to control flow through outlet 45 the solenoid valve coil is controlled by a differential pressure sensing switch 54, which is mounted in line 55 between the discharge line 22 and the suction line 29. Thus, the pressure sensing switch is responsive to the difference in pressure between the condenser 23 and the compressor inlet 29. The required pressure differential between the pressure in the condenser and the system suction pressure necessary to actuate switch 54 differs, depending upon the application. The invention is not limited to any specific pressure differential and the pressures described herein are for purposes of example.

The pressure differential switch 54 of FIGS. 1, 2 and 3 provides the control for selectively positioning the piston and valve in the valve assembly 20. The sensing device 54 has a built-in operating dead band which, for one example, may be 4 PSI. It may also be assumed for purposes of this example that the desired average pressure differential between the condenser 23 and the suction line 29 to actuate switch 54 is 30 PSID (pounds per square inch differential). Sensing device 54 will make an electrical contact at 32 PSID and above and will break that electrical conduct at 28 PSID and lower. In the shutdown condition of the valve, as illustrated in all of the FIGS., the sensing device 54 is taken out of control by an electrical interlock, not shown, in the line with the compressor motor starter.

When solenoid valve 46 in FIG. 1 is deenergized this permits its valve to close. When the solenoid valve 46 is closed this prevents any further removal of vapor from the space within the cylinder 34 of the valve housing and at the end 43 of the valve housing and thus prevents any further reduction of pressure on top of the piston; at the same time vapor at the condensing pressure within the bell portion 37 bleeds through the opening 50 to the top of the piston within cylinder 34.

When the vapor pressures on the top and bottom of the piston are equalized the spring 40 is able to move the assembly toward the seat 30 as illustrated in FIG. 1. This will close the valve if the compressor is not running. If the compressor is running, the valve will begin to throttle the gas flow from 13 to 22, creating a pressure drop on the gas that is equivalent to the spring force divided by the area of the valve button 31.

On restarting, or if during compressor operation the differential in pressure between the condenser and the suction line is less than 28 PSID, in the example discussed, the sensing device 54 deenergizes solenoid valve 46, thus moving the valve toward the closed or throttling position. With the valve closed, as at restart, the pressure in the oil separator is instantly raised. During compressor operation vapor flow through the valve is throttled or shutoff, maintaining the pressure in the oil separator 12 at 28 to 32 PSID above condensing pressure, thus providing a continuous oil flow into the compressor through line 17 and avoiding a shutdown due to low oil pressure.

The manual valve 47 may be adjusted to a throttling condition in order to limit the rate of pressure reduction when the valve member is moving upwardly, in order to vary the vapor flow rate through the valve housing.

In the embodiment of FIG. 1, the bleed hole 50 in the valve member provides a continuous vapor flow, from condensing pressure to suction pressure, when the valve 46 is open to provide for suction pressure on top of the piston of the valve assembly. Since the bleed hole 50 is small the rate of valve closing, requiring vapor flow through the valvehead, is relatively slow, compared with the embodiments of FIGS. 2 and 3, when solenoid valve 46 is closed.

In the embodiment of FIG. 2, a drilled hole 60 is provided in the outlet 21 of the valve housing and has a bypass line 61 connected thereto which extends to the line 45 from the upper end of the valve assembly, and having a solenoid valve 62 and bleed valve 63 therein.

In FIG. 2, both the solenoid valves 62 and 46 are under the control of the pressure differential switch 54. When the pressure drop across the switch 54 is below a predetermined level the solenoid valve 62 is normally open and the solenoid valve 46 is closed.

In FIG. 2, since there is no internal bleed hole as in FIG. 1, when the pressure difference across the control 54 is above a predetermined minimum, valve 62 being closed and valve 46 open, the valve button 31 being off its seat, there is no leak or bypass path for the vapor within the valve housing 20. However, as soon as the valve member closes, the solenoid valve 62 opens a path around the piston 35 which permits rapid equalization of the pressure on both sides of the piston head and the closing of the piston by the operation of the spring 36.

Reference is now made to FIG. 3. Here, the housing of the valve has a partition 66 between the valve button 31 and the piston head 35. Thus, there is no leakage of vapor from the lower portion of the valve housing into the area of the piston. The bypass line 68 in the embodiment of FIG. 3 extends from an opening 60 as in FIG. 2, to link up with the suction line 48 by means of a solenoid valve 62, as in FIG. 2. However, the bypass line 68 has a branch line 70 through an opening 71 in the valve housing which communicates with the space 72 between the partition 66 and the piston head 35.

In the example given, when the oil pressure is above 32 PSI, the pressure differential as sensed by the switch 54 being sufficient to open solenoid valve 46, the pressure on top of the piston of the cylinder and piston assembly then corresponding to suction pressure, the valve is permitted to be in full open position due to the difference in vapor pressure in the upper and lower faces of the piston.

However, if the oil pressure drops to the lower limit, for example 28 PSI, the pressure difference being sensed by the switch 54, the solenoid valve 46 is closed, and in FIGS. 2 and 3 the solenoid valve 62 is opened, thus permitting the pressure on top of the piston to reach the discharge pressure in which the spring moves the cylinder and piston into position in which the button 31 contacts the seat 30 thereby throttling and stopping compressor discharge gas flow through the valve 20 but at the same time maintaining adequate pressure in the oil separator for the oil to circulate to the compressor.

In addition to the operation described above, it will be apparent that the valve assembly takes the place of a normally used check valve in order to prevent high pressure vapor back flow which could cause reverse rotation of the rotors in a screw compressor following and during a shutdown. This function is in addition to the primary purpose of providing a throttling means for maintaining the required pressure in the oil separator to provide delivery of oil through the oil cooling system and into the compressor.

It will also be understood by those skilled in the art that in the electrical arrangement of FIG. 1 the starter interlock is connected to the switch 54 so that the switch is in the position in which the solenoid 46 is normally closed. Similarly, in FIGS. 2 and 3, a conventional relay is connected with the switch 54 and the compressor motor starter interlock and operates both the solenoid valves 46 and 62. It will also be understood that in the system as described when the compressor is shutdown or when the difference in pressure between the compressor vapor inlet and the condenser is below a predetermined minimum that the solenoid 46 is normally closed and the solenoid 62 is normally open.

It will also be understood by those skilled in the art that the bypass line 48 could be connected to various vapor inlet connections on the compressor, located at varying pressure levels, as well as the vapor inlet connected to the evaporator. For example, in a screw compressor there may be alternative inlets between the conventional suction inlet to the evaporator and the discharge, for the purpose of drawing in higher pressure vapor from higher temperature evaporators or from other higher pressure gas sources.

We claim:

1. In a screw compressor vapor system having a high pressure and a low pressure side, the compressor having a vapor inlet and a vapor outlet, an oil separator connected to the outlet, the oil separator having an oil outlet and a vapor discharge outlet, the improvement comprising, flow control valve means connected to the vapor discharge outlet, and differential pressure switch means responsive to the difference in pressure between the high and low pressure sides and controlling the flow through said valve means.

2. The invention of claim 1, in which the high pressure side includes a condenser, and the differential pressure switch is responsive to the difference in pressure between a compressor inlet and the condenser.

3. The invention of claim 1, in which the high pressure side includes a condenser having a vapor inlet, said flow control valve means comprising a housing, a valve member mounted in said housing, said valve member movable between open and closed positions, said valve member having a control element with opposing pressure receiving portions, said control element selectively communicating with the condenser vapor inlet and a compressor inlet and movable in response to pressure differences therebetween, said differential pressure switch means controlling the communication of said control element to said compressor inlet.

4. The invention of claim 3, and a bypass means between the vapor discharge outlet and the compressor inlet.

5. The invention of claim 4, in which the bypass means is controlled by said pressure switch means.

6. The invention of claim 4, in which said bypass means is a restricted passage.

7. The invention of claim 4, in which said bypass means communicates by a branch line with said compressor inlet, said branch line having separate control means, and said separate control means is controlled by said pressure switch means.

8. The invention of claim 4, said housing having a vapor inlet connected to said oil separator vapor discharge outlet and a vapor outlet spaced therefrom, said valve member having a flow control face selectively opening and closing said housing vapor inlet, thereby making and breaking communication between said oil separator vapor discharge outlet and the valve member vapor outlet.

9. The invention of claim 8, and separate means urging said valve member toward closed position, said bypass means operating to permit flow to equalize the pressure on opposing pressure receiving portions of said control element when the differential pressure switch means closes communication of said control element to said compressor inlet, thereby permitting said separate means to close said valve member.

10. In a screw compressor vapor system, the compressor having an inlet and an outlet, an oil separator connected to the outlet, the oil separator having an oil discharge outlet and a vapor discharge outlet, the improvement comprising, a valve assembly having a housing with a vapor inlet connected to the vapor discharge outlet, said housing having a vapor outlet spaced from said vapor inlet by a passage, a valve member mounted in said housing and movable between a position in which the passage between said vapor inlet and outlet is open to that in which it is closed, means urging said valve member toward the closed position, means connecting a compressor inlet to said valve housing and permitting selective communication with a first side of said valve member, said valve housing vapor outlet communicating with a second side of said valve member, bypass means between the valve housing outlet and a compressor inlet, means for controlling the flow through said bypass means, and means responsive to the difference in pressure between the compressor inlet and the condenser for controlling the communication through said connecting means.

11. The invention of claim 10, in which the bypass means is controlled by said pressure difference responsive means.

12. The invention of claim 10, in which said housing has a cylinder means and said valve member has a piston means moveable therein, and said valve member has a spaced closure member engagable with the housing vapor inlet, and said bypass means is a restricted passage through said piston means.

13. The invention of claim 10, in which said housing has a wall means between said second side of said valve member and said valve housing vapor outlet, the space therebetween varying as the valve member moves, and said bypass means communicates with said space, said passage, and selectively with said compressor inlet.

* * * * *